US007798846B2

(12) United States Patent
Yuan

(10) Patent No.: US 7,798,846 B2
(45) Date of Patent: Sep. 21, 2010

(54) ELECTRICAL CONNECTOR ASSEMBLY WITH A JUMPER DEVICE

(75) Inventor: Wei Yuan, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/492,168

(22) Filed: Jun. 26, 2009

(65) Prior Publication Data

US 2009/0325418 A1 Dec. 31, 2009

(30) Foreign Application Priority Data

Jun. 26, 2008 (CN) ..... 2008 2 0040921

(51) Int. Cl.
*H01R 31/08* (2006.01)

(52) U.S. Cl. ..... 439/510; 439/528

(58) Field of Classification Search ..... 439/505, 439/507, 509, 510, 512, 528
See application file for complete search history.

(56) References Cited

U.S. PATENT DOCUMENTS 4,662,697 A * 5/1987 Moses ..... 439/148
5,320,542 A * 6/1994 Cheng ..... 439/148
5,339,232 A * 8/1994 Lin ..... 362/391
5,370,542 A * 12/1994 Beach et al. ..... 439/148
6,577,115 B1 * 6/2003 Carpenter ..... 324/127
6,913,395 B2 * 7/2005 Watanabe et al. ..... 385/78
7,442,077 B2 * 10/2008 Peress et al. ..... 439/505

FOREIGN PATENT DOCUMENTS

TW 239606 1/1995

* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

An electrical connector assembly includes a cable connector having a cable therein and a jumper device retained on the cable. The jumper device includes an insulative base having a body portion mounted a jumper contact therein and a retaining portion engaging with the cable so as to keep the jumper device retaining on the cable. The jumper device is keeping retaining on the cable no matter whether the jumper device is in a work status, which is benefit for an operator to use.

6 Claims, 5 Drawing Sheets

ELECTRICAL CONNECTOR ASSEMBLY WITH A JUMPER DEVICE

BACKGROUND OF THE INVENTION

1. Field of the Invention

The present invention relates to an electrical connector assembly, and particular to an electrical connector assembly having a jumper device.

2. Description of the Related Art

TW Pat. No. 239606 discloses a conventional jumper device including an insulating base and a jumper contact mounted therein. The jumper device is used temporarily to complete a circuit or to bypass a break in a circuit. That is to say, when an electronic device is needed to accomplish above mentioned function, the jumper device is brought out and assembled onto a corresponding component of the electronic device. If there is no such need, the jumper device will be picked up from the electronic device. Under this condition, the jumper device is used as a spare accessory and may be lost during the usage especially the jumper device is too small. Hence, an electrical connector assembly which can solve the problem is needed.

SUMMARY OF THE INVENTION

Accordingly, an object of the present invention is to provide an electrical connector assembly with a jumper device thereon, and the jumper device is facility for a user.

In order to achieve the object set forth, an electrical connector assembly includes a cable connector having a cable therein and a jumper device retained on the cable. The jumper device includes an insulative base having a body portion mounted a jumper contact therein and a retaining portion engaging with the cable so as to keep the jumper device retaining on the cable.

Other objects, advantages and novel features of the invention will become more apparent from the following detailed description of the present embodiment when taken in conjunction with the accompanying drawings.

DETAILED DESCRIPTION OF THE INVENTION

Figure 1:
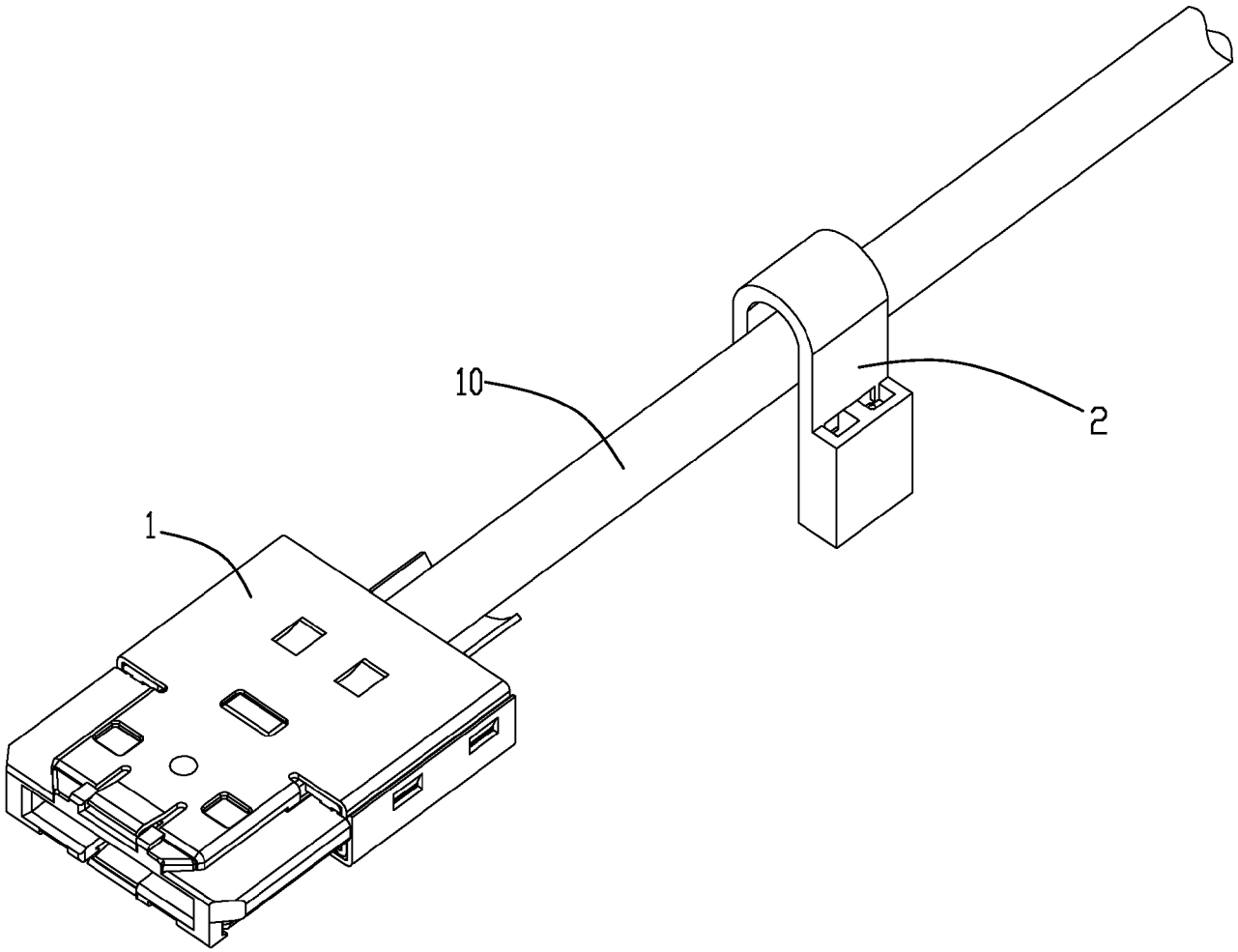
FIG. 1 is an assembled perspective view of an electrical connector assembly with a jumper device mounted thereon in accordance with the present invention.
Figure 2:
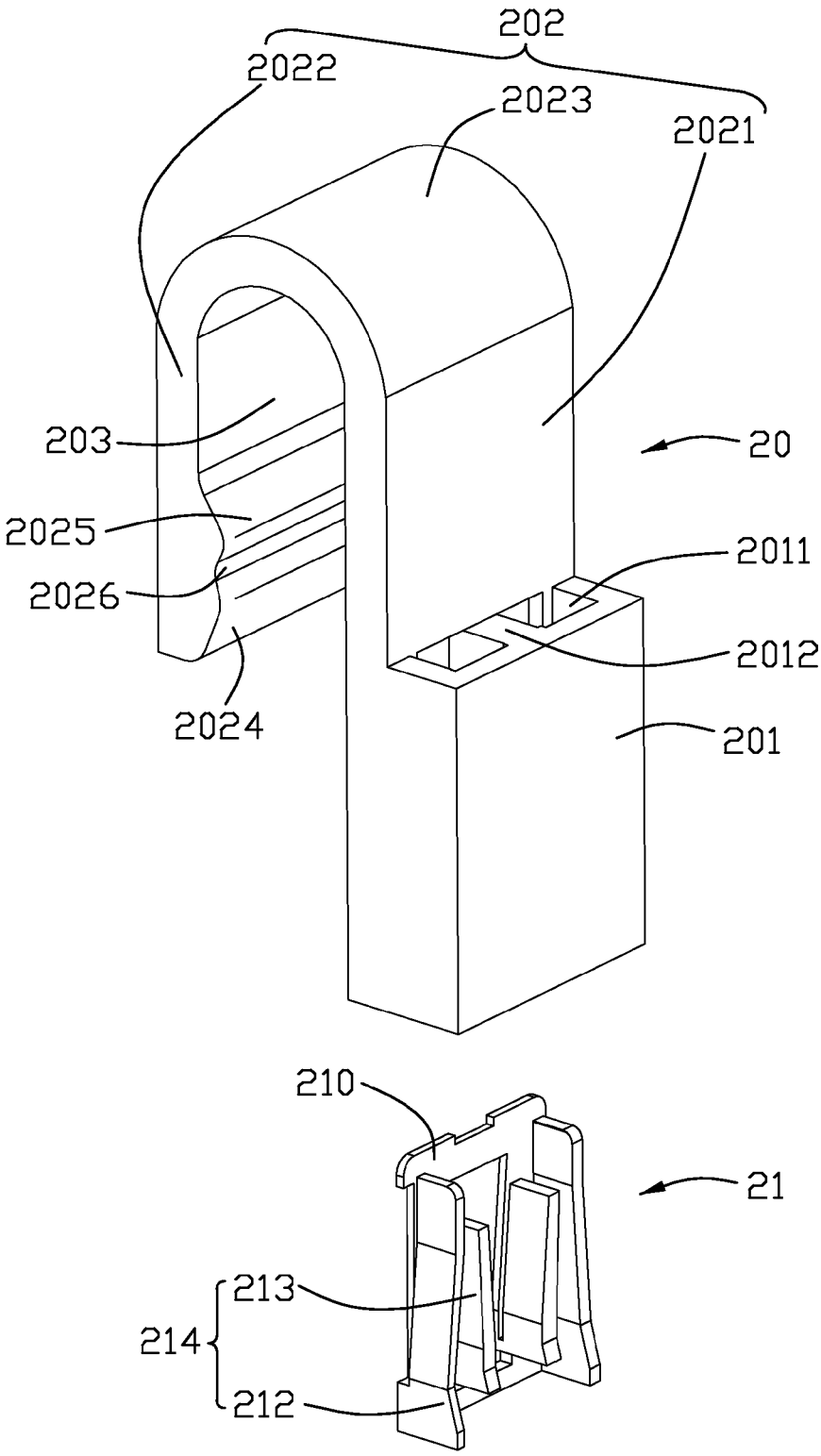
FIG. 2 is a perspective view of a first embodiment of the jumper device shown in FIG. 1.

Reference will now be made to the drawing figures to describe a preferred embodiment of the present invention in detail. Referring to FIGS. 1 and 2, an electrical connector assembly according to the preferred embodiment of the present invention is provided and comprises a cable connector 1 and a jumper device 2. The jumper device 2 is attached to a cable 10 of the cable connector 1.

Referring to FIG. 2, the jumper device 2 of the first embodiment is shown, which comprises an insulative base 20 and a jumper contact 21 retained in the insulative base. The jumper contact 21 is made by stamping and bending a piece of metal sheet and forms a rectangular main body 210. Two pairs of resilient arms 214 are formed by bending from the main body 210. Each pair 214 has two upward and face-to-face plates 211, 213 to form a clip configuration. The distance between each pair of the resilient arms becomes narrow and narrow thereby defining a wedge shaped receiving passageway therebetween.

The insulative base 20 comprises a rectangular body portion 201 and a retaining portion 202 extends from one end of the body portion 201. The body portion 201 defines two passageways 2011 in a parallel relationship thereby forming a separation portion 2012 therebetween. The jumper contact 21 is retained in the body portion 201 by the first and second bending plates 212, 213 at the same side being received in the passageway 2011.

The retaining portion 202 is in an "n" shape and comprises a first and a second coupling portions 2021, 2022 in a parallel relationship and a curved connecting portion 2023 connecting with upper edges of the first and second coupling portions 2021, 2022 thereby defining a holding space 203 therein for receiving a cable 10 of the cable connector 1. A guiding portion 2024 is formed at a distal end of the second coupling portion 2022 and forms a guiding surface slanting downwardly and outwardly so as to provide an easy insertion for the cable 10. A locking portion 2025 protrudes into the holding space 203 from an inner side of the second coupling portion 2022 and separates to the guiding portion 2024 by a recessed groove 2026. The locking portion 2025 is actually a protruding rib extending along a transverse direction for preventing the cable 10 from releasing from the holding space 203. The recessed groove 2026 temporarily receives the cable 10 therein and reduces the insertion force of the cable 10.

When the jumper device 2 is assembled onto the cable 10 of the cable connector 1 along a mating direction, the guiding portion 2024 leads the cable 10 to slide into the recessed groove 2026, then the cable 10 surpasses the locking portion 2025 to enter into the holding space 203. The locking portion blocks the downward movement of the cable 10 after the cable 10 enters into the holding space 203. As the connecting portion 2023 is in the curved shape, the cable 10 fitly engages with an inner face of the connecting portion 2023 to get a better retaining effect.

Figure 3:
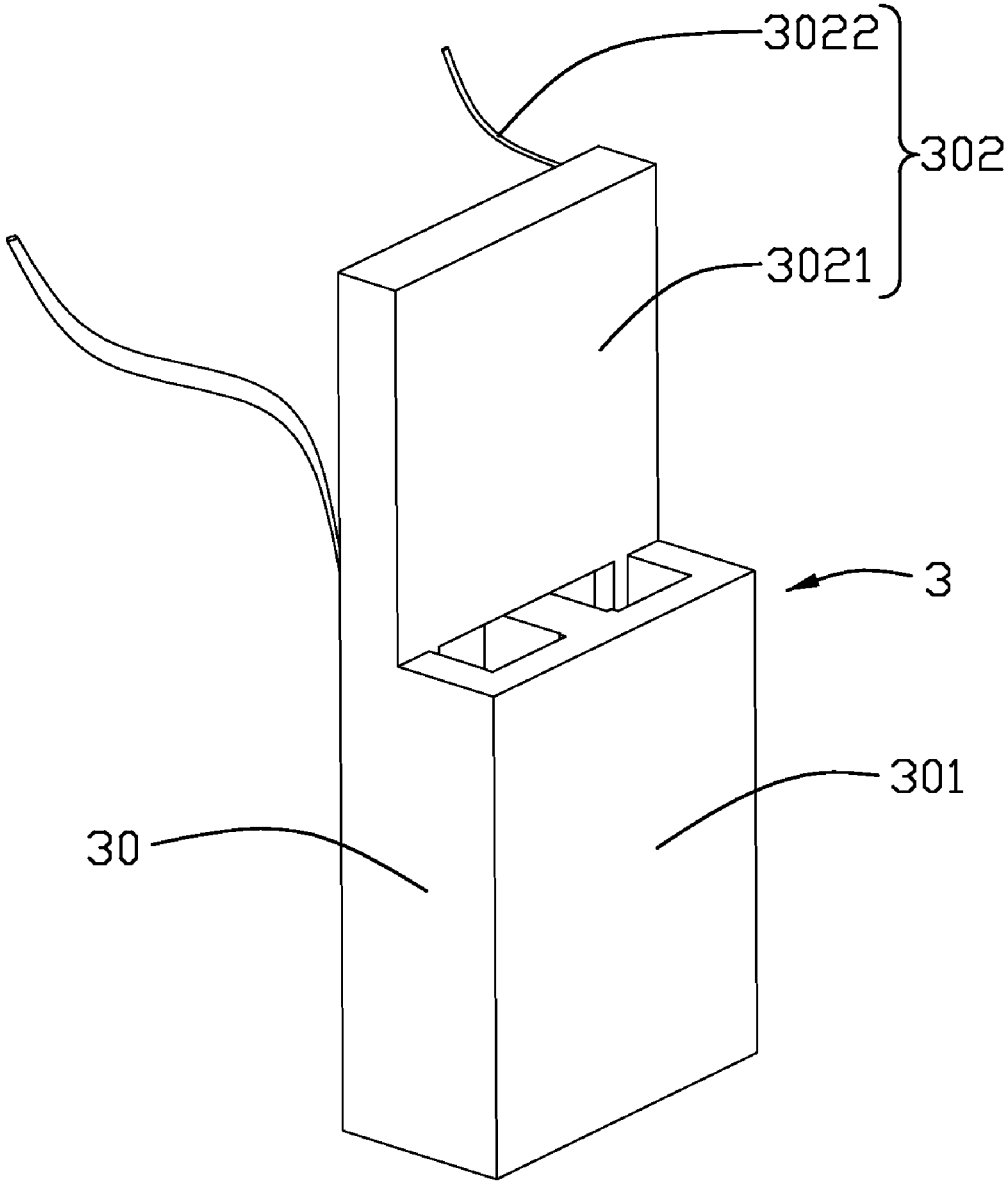
FIG. 3 is a perspective view of a second embodiment of the jumper device.

FIG. 2 to FIG. 5 show other embodiments of the jumper devices, the body portions of the insulative base and the jumper contact retained therein are similar to those in the first embodiment, and the only difference is the configuration of the retaining portion. Referring to FIG. 3, the jumper device of a second embodiment comprises an insulative base 30 and jumper contact (not shown) received in the base 30. The insulative base 30 has a rectangular body portion 301 and an extending portion 3021 extending upwardly from an upper edge of the body portion 301. A pair of ties 3022 made by plastic material or metal material, are arranged at opposite sides of the extending portion 3021 in a manner of insert molding or in a manner of through hole. The ties 3022 are used to tie the extending portion 3021 to the cable 10 so as to keep the jumper device 3 retaining on the cable 10. The extending portion 3021 together with the ties 3022 are named as retaining portion 302 of the insulative base 30.

Figure 4:
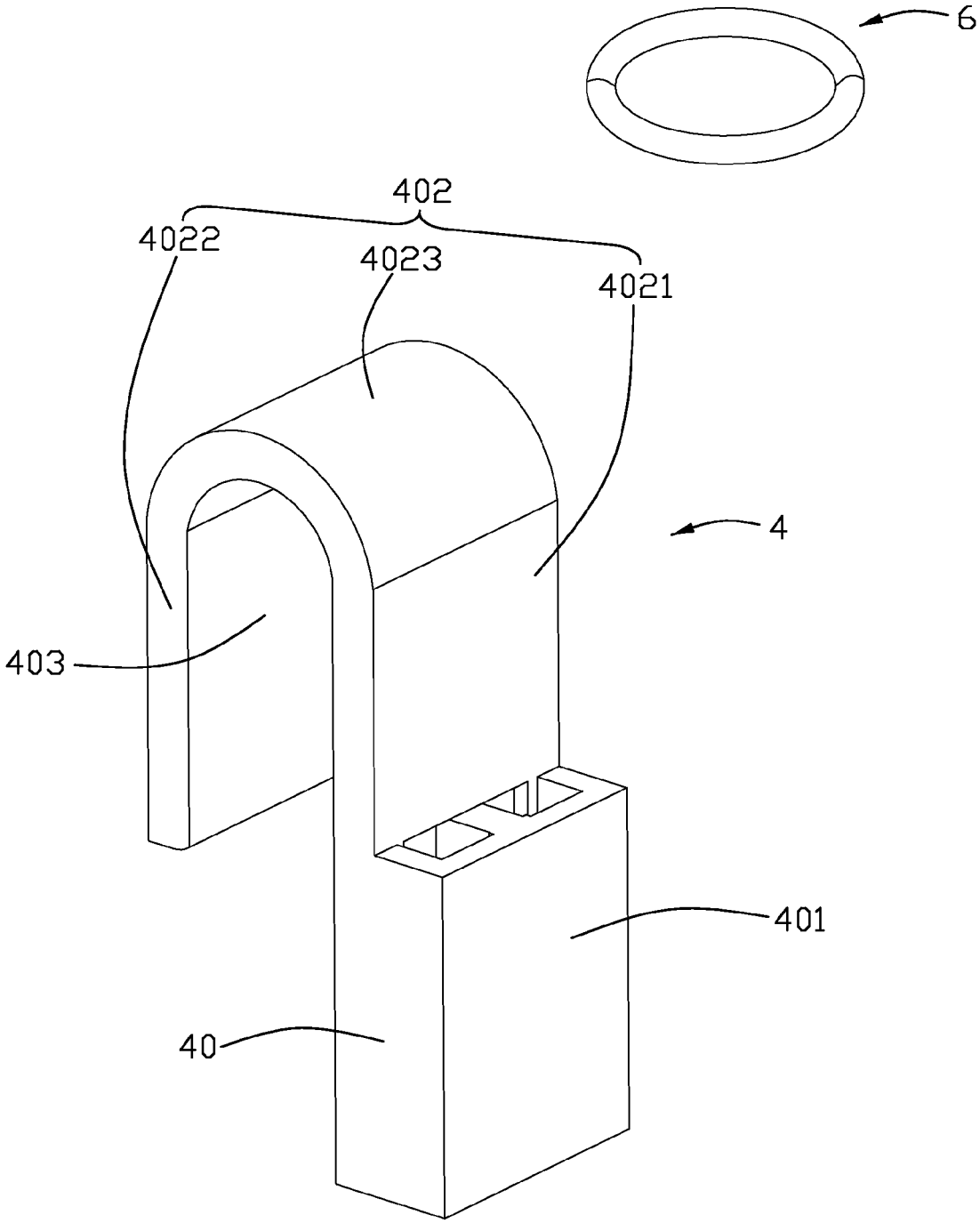
FIG. 4 is a perspective view of a third embodiment of the jumper device together with a tie.

Referring to FIG. 4, the jumper device 4 of a third embodiment comprises an insulative base 40 and jumper contact (not shown) received in the base 40. The insulative base 40 is similar to the insulative base 20 in the first embodiment, and comprises a body portion 401 and an "n" shaped retaining portion 402. The retaining portion 402 comprises a first and a second coupling portions 4021, 4022 with smooth inner surfaces and a connecting portion 4023 defining a holding space 403 for receiving the cable 10 therein. An elastic tie 6 is also provided to further retain the cable 10 in the holding space 403 of the jumper device 4, therefore the elastic tie 6 is seen as part of the retaining portion 402.

Figure 5:
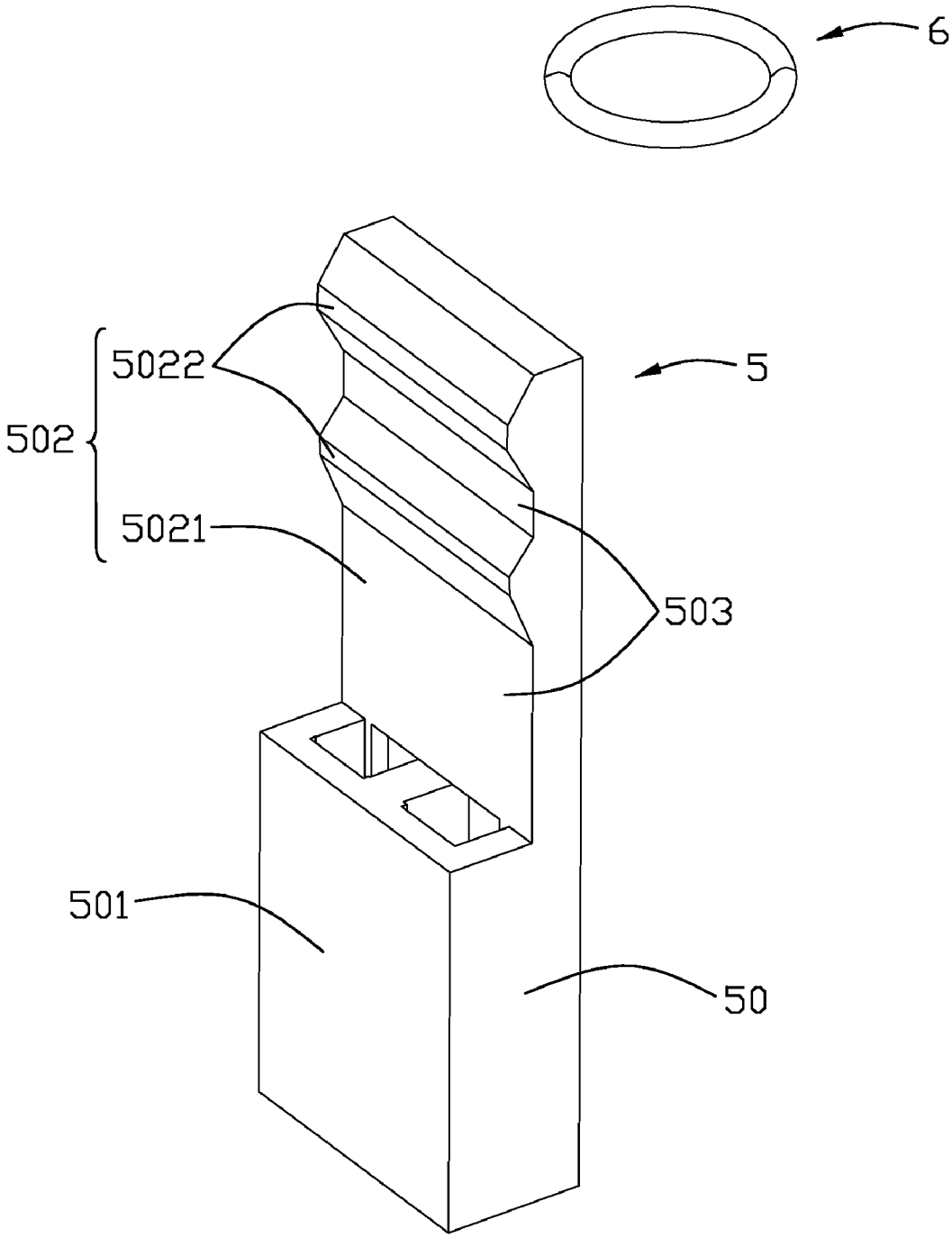
FIG. 5 is a perspective view of a forth embodiment of the jumper device together with the tie.

Referring to FIG. 5, the jumper device 5 of a fourth embodiment comprises an insulative base 50 and jumper contact (not shown) received in the base 50. The insulative base 50 comprises a body portion 501 and an extending portion 5021 upright extending from the body portion 501. A plurality of ribs 5022 are formed on the extending portion 5021 and define recessed grooves 503 therebetween. The recessed grooves 503 are arranged in different widths so as to receive cable 10 with different dimension. An elastic tie 6 is also provided to retain the cable 10 in the recessed groove 503. The extending portion 5021 together with the tie 6 are named as retaining portion of the insulative base 50.

The jumper device are retained on the cable 10 by the retaining portion buckling with the cable 10 or by the affiliated ties cooperating with the retaining portion to fasten onto the cable 10, therefore the jumper device is keeping retaining on the cable 10 no matter whether the jumper device is in a work status, which is benefit for an operator to use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a cable connector having a cable therein; and a jumper device retained on the cable, comprising an insulative base having a body portion mounted a jumper contact therein and a retaining portion engaging with the cable so as to keep the jumper device retaining on the cable;

wherein the retaining portion comprises a first and a second coupling portions in a parallel relationship and a connecting portion connecting with the first and second coupling portions thereby defining a holding space therebetween to receive the cable therein;

wherein a locking portion is formed on an inner face of the second coupling portion and protrudes into the holding space to prevent outward-movement of the cable after the cable surpasses the locking portion;

wherein a guiding portion is formed at a distal end of the second coupling portion to lead the cable entering into the holding space; and wherein a recessed groove is defined between the guiding portion and the locking portion to temporarily receive the cable therein and reduce the insertion force of the cable.

2. The electrical connector assembly as described in claim 1, wherein at least one tie is provided to bind the cable with the first and second coupling portions.

3. The electrical connector assembly as described in claim 1, wherein the retaining portion comprises an extending portion extending from an edge of the body portion and a plurality of ties extending from the body portion.

4. The electrical connector assembly as described in claim 1, wherein the retaining portion comprises an extending portion extending from an edge of the body portion and at least one tie fastening the extending portion to the cable, the extending portion defines a plurality of recessed grooves in different width for receiving cables in different dimension.

5. A jumper device comprising:

an insulative base having a body portion and a retaining portion; and a jumper contact retained in the body portion and defining a mating direction;

wherein the retaining portion extend from the body portion along the mating direction and is detachably retained to a cable;

wherein the retaining portion comprises a first and a second coupling portions in a parallel relationship and a connecting portion connecting with the first and second coupling portions thereby defining a holding space therebetween for receiving the cable therein;

wherein a locking portion is formed on an inner face of the second coupling portion and protrudes into the holding space for preventing the outward movement of the cable after the cable surpasses the locking portion;

wherein a guiding portion is formed at a distal end of the second coupling portion for leading the cable entering into the holding space; and wherein a recessed groove is defined between the guiding portion and the locking portion for temporarily receiving the cable therein and reducing the insertion force of the cable.

6. The jumper device as described in claim 5, wherein the jumper contact comprises a main body and two pairs of resilient arms upward and face-to-face extending from opposite sides of the main body to form a clip configuration.

* * * * *